United States Patent [19]

Larin

[11] Patent Number: 5,005,363

[45] Date of Patent: Apr. 9, 1991

[54] CRYOGENIC SORPTION PUMP

[76] Inventor: Marxen P. Larin, prospekt Nauki, 29 kv. 78, Leningrad, U.S.S.R.

[21] Appl. No.: 408,505

[22] PCT Filed: Nov. 14, 1988

[86] PCT No.: PCT/SU88/00228

§ 371 Date: Aug. 16, 1989

§ 102(e) Date: Aug. 16, 1989

[87] PCT Pub. No.: WO89/05917

PCT Pub. Date: Jun. 29, 1989

[30] Foreign Application Priority Data

Dec. 17, 1987 [SU] U.S.S.R. ..... 4344470/29

[51] Int. Cl.[5] ..... B01D 8/00

[52] U.S. Cl. ..... 62/55.5; 55/269; 62/268; 417/901

[58] Field of Search ..... 62/100, 55.5, 268; 417/901; 55/269

[56] References Cited

U.S. PATENT DOCUMENTS

| | | | |
|---|---|---|---|
| 3,335,550 | 8/1967 | Stearn | 62/55.5 |
| 3,344,852 | 10/1967 | Bergson | 62/55.5 |
| 3,371,499 | 3/1968 | Hagenbach et al. | 62/55.5 |
| 3,416,326 | 12/1968 | Stuffer | 62/55.5 |
| 3,552,485 | 1/1971 | LeJannou | 62/55.5 |
| 3,668,881 | 6/1972 | Thibault et al. | 62/55.5 |
| 3,788,096 | 1/1974 | Brilloit | 62/55.5 |
| 4,446,702 | 5/1984 | Peterson et al. | 62/55.5 |

FOREIGN PATENT DOCUMENTS

| | | |
|---|---|---|
| 1285091 | 8/1969 | Fed. Rep. of Germany . |
| 1938035 | 3/1985 | Fed. Rep. of Germany . |
| 694656 | 10/1979 | U.S.S.R. . |
| 1333833A1 | 8/1987 | U.S.S.R. . |
| 1502877 | 3/1978 | United Kingdom . |

OTHER PUBLICATIONS

Journal of the USSR Academy of Sciences, 1983 pp. 128–132.

*Primary Examiner*—Ronald C. Capossello
*Attorney, Agent, or Firm*—Lilling and Lilling

[57] ABSTRACT

A cryogenic sorption pump comprises a housing complete with a cover, a bottom, and an inlet nozzle, and, a vessel for cryogenic agent, designed in the form of two shells installed in the central part of the pump one over the other and interconnected by a circular element. The cryogenic agnet vessel is provided with a heat conductor encompassing the upper shell and forming an interspace therewith, wherein is installed a gas-permeable screen. Between the heat conductor and the gas-permeable screen is located an adsorbent. The pump contains a vacuum conductor arranged within the space of the cryogenic agent vessel and provided with heat conductors attached to the vacuum conductor and installed inside the shells, respectively, throughout their length. The ends of the vacuum conductor are provided with heat bridges, respectively, and taken out of the housing through the bottom. The pump is also provided with pipes and for filling in cryogenic agent and removing cryogenic agent vepors, respectively.

5 Claims, 3 Drawing Sheets

CRYOGENIC SORPTION PUMP

FIELD OF THE INVENTION

The present invention relates to vacuum engineering and, more specifically, to cryogenic sorption vacuum pump designs. The invention can be used to best advantage in vacuum equipment employed extensively in electronic, radio, and other industries, as well as for research studies, both as a preliminary means and as the principal facility for obtaining superclean and oil-free vacuum in working chambers of $1 \cdot 10^{-3}$ to $1 \cdot 10^{2}$ $m^3$ volume and with a pressure range of $1 \cdot 10^{5}$ to $1 \cdot 10^{-2}$ or $1 \cdot 10^{2}$ to $1 \cdot 10^{-7}$ Pa or lower.

DESCRIPTION OF THE PRIOR ART

At the present time, improvements in cryogenic sorption pumps follow the route of optimizing their designs both by developing new arrangement versions and by providing new pump design elements. Both of these directions are aimed at improving the pumping (evacuation) and cryogenic characteristics of said pumps.

There is known a cryogenic sorption pump comprising a housing complete with a cover, a bottom, and an inlet nozzle provided on the cover, a vessel for cryogenic agent, arranged within the housing and provided with a gas-permeable screen, a heat bridge connecting the inlet nozzle with the cryogenic agent vessel, an adsorbent, and pipes to fill in cryogenic agent and remove cryogenic agent vapuors (N. P. Larin "Sverkhvysokovakuumny agregat s gelievym kriogennym nasosom". In: Pribory i tekhnika experimenta (Journal of the USSR Academy of Sciences), 1983, No. 6, pp. 128–132, p. 129).

One disadvantage of said pump is that, for completely oil-free high vacuum to be obtained by means of this pump in a working chamber, additional facilities have to be employed, such as a mechanical fore pump used in conjunction with a liquid nitrogen-cooled oil vapour trap. Currently used trap designs of this type are uneconomical, considering the high liquid nitrogen consumption rates and the short useful life for a single liquid nitrogen filling, up to 10–35 hours, necessitating a considerable amount of additional labour consumption for regeneration and washing of traps and connection piping, as well as unproductive liquid nitrogen consumption for subsequent trap cooling from room temperature to 77.4K.

Another known cryotenic sorption pump comprises a housing complete with a cover, a bottom, and an inlet nozzle arranged on the cover, a vessel for a cryogenic agent, accommodated within the housing and provided with a gas-permeable screen, a heat bridge connecting the inlet nozzle with the cryogenic agent vessel, an adsorbent, pipes to fill in cryogenic agent and remove cryogenic agent vapours, and a vacuum conductor arranged within the cryogenic agent vessel space and having one end taken out of the housing through its bottom (SU, A, 1333833).

The cryogenic agent vessel in said unit has the form of two coaxial—inner and outer—cylinders forming a space to be filled with the cryogenic agent. Arranged within the inner cylinder of the cryogenic agent vessel, coaxial therewith, is a gas-permeable screen forming a cavity to be filled with adsorbent. The cavity in the central part of the pump, enclosed by the closed gas-permeable screen, serves for the supply of evacuated gas to the adsorbent. The vacuum conductor is arranged inside the cryogenic agent vessel, with one end being taken out through the bottom, and the other, through the housing cover. The vacuum conductor is in the form of a half-turn of a helix, passing around the inner cylinder of the cryogenic agent vessel, with the dimensions of the vacuum conduit being defined by the following relationships:

$$R > d$$

and $$R > \frac{h}{6}$$

where R is the radius of the half-turn of the helix, d is the diameter of the vacuum conductor, and h is the lead of the helix. The vacuum conductor is used at the preliminary stage of evacuation of the working chamber by the machanical fore pump, serving the function of a freeze-out trap, its walls condensing such gases and vapours that easily condense at the temperature of the cryogenic agent, thus oil vapours from the mechanical fore pump.

The unit as described above is disadvantageous in that, with the cryogenic agent vessel having the form of an annular space between two coaxial cylinders and the adsorbent located between the inner cylinder and the gas-premeable screen being of limited thickness, the volume of adsorbent and the surface area of the gas-permeable screen fail to match the pump size, leading to lower pumping characteristic values, i.e. those of adsorption capacity and pumping speed.

Besides, such design and arrangement of the vacuum conductor will limit its diameter and length. The vacuum conductor diameter is limited by the width of the annular space in the cryogenic agent vessel, while the length of the vacuum conductor cannot be lower than the height of the pump housing. Said vacuum conductor parameters, i.e. diameter and length, define the conduction capacity of the vacuum conductor so that their limitations will lead to lower vacuum conduction capacity of the vacuum conductor to necessitate a sufficiently long time for the preliminary evacuation of the working chamber.

Also, the cryogenic agent vessel designed as described above fails to make an effective use of the inner pump volume to increase the capacity of said vessel and the quantity of cryogenic agent that could be filled in. The insufficient capacity of the cryogenic agent vessel will lead to shorter continuous pump duty times, i.e. to poorer cryogenic characteristics.

SUMMARY OF THE INVENTION

The invention is based upon providing a cryogenic sorption pump comprising a vessel for a cryogenic agent, an adsorbent, a gas-permeable screen, and a vacuum conductor arranged within the space of the cryogenic agent vessel, wherein said elements would be so designed and so arranged within the pump housing that, with the pump size retained, the gas-permeable screen surface area might be enlarged, the adsorbent volume increased, the vacuum conductor conduction capacity increased, and the pumping characteristics thereby improved, thus increasing the pumping speed, enhancing the adsorption capacity of the pump, and reducing the working chamber evacuation time.

The objective as stated above is achieved by providing a cryogenic sorption pump comprising a housing complete with a cover, a bottom, and an inlet nozzle arranged on the cover; a vessel for a cryogenic agent, arranged within the housing; an adsorbent; a gas-permeable screen; a heat bridge, a vacuum conductor arranged within the cryogenic agent vessel and having one end taken out of the housing through the bottom; and pipes to fill in the cryogenic agent and remove cryogenic agent vapours according to the invention the cryogenic agent vessel is designed in the form of two shells installed in the central part of the pump one over the other and interconnected by a circular element, the upper shell comprising a cover, and the lower shell comprising a bottom. The cryogenic agent vessel is provided with a heat conductor attached to the circular element and encompassing the upper shell, with an interspace formed between the shell and the heat conductor and a gas-permeable screen attached to the circular element installed therein. The adsorbent is located between the heat conductor and the gas-permeable screen. The vacuum conductor is provided with heat conductors attached thereto and installed within the cryogenic agent vessel shells along their entire length, with the other end of the vacuum conductor being taken out of the housing through the bottom.

The cryogenic agent vessel design in the form of two shells installed in the central part of the pump and interconnected by a circular element, as well as the provision of a heat conductor attached to the circular element, with an interspace formed between the upper shell and the heat conductor, firstly provide for effective cooling of the heat conductor by cryogenic agent through the circular element and, secondly, permit of increasing the heat conductor diameter to the maximum.

The arrangement of the gas-permeable screen within the interspace between the heat conductor and the upper shell permits of considerably increasing the gas-permeable screen surface area by increasing the screen diameter thus enhancing the pumping speed. The arrangement of the adsorbent between the heat conductor and the gas-permeable screen affords effective adsorbent cooling. Thus, with a limited adsorbent thickness, the total volume of the adsorbent increases due to the increased heat-conductor and gas-permeable screen diameters, hence due to the increased cross-sectional area of the annular space accommodating the adsorbent, thereby enhancing the adsorption capacity of the pump.

The second end of the vacuum conductor being taken out of the housing through the bottom, in the same way as the first one, provides for an optically dense loop-like vacuum conductor excluding straight-line flight of vapour and gas molecules therethrough.

The arrangement of the vacuum conductor executed as described above, within one of the shells constituting the vessel for cryogenic agent makes it possible to increase the diameter and reduce the length of the vacuum conductor, enhancing the conduction capacity of the vacuum conductor and thereby reducing the working chamber evacuation time. Besides, with the second end of the vacuum conductor taken out through the bottom, the pump cover is set free, and improved conditions are made possible for joining the pump to the working chamber and to the mechanical fore pump, all this making for convenience of pump operation.

The provision of the vacuum conductor with heat conductors secured thereto and installed within the shells of the cryogenic agent vessel throughout their length provides for effective vacuum conductor cooling at the preliminary stage of evacuation of the working chamber, whatever the cryogenic agent level in the vessel and irrespective of the pump orientation, inlet nozzle up or down, thereby creating suitable conditions for optimizing the pumping characteristics at the subsequent stages of evacuation of the working chamber.

It will be added that the cryogenic agent vessel design as described above permits of effectively using the inner pump space to increase the capacity of the vessel and the amount of cryogenic agent that can be filled in, thus resulting in increased continuous pump operation times, hence in improved cryogenic characteristics for the pump.

It is convenient that the pipes used to fill in cryogenic agent and remove its vapours be arranged within the space of the cryogenic agent vessel and have one end taken out of the housing through the bottom, with the other end of one of the pipes being located near the cover of the upper shell, and that of the second pipe, near the bottom of the lower shell.

This type of arrangement for the pipes to fill in cryogenic agent and to remove its vapours will increase the pipe lengths, resulting in lower heat inputs and lower cryogenic agent evaporativity to improve the cryogenic characteristics of the pump.

Besides, the aforesaid arrangement of the pipes provides the possibility of operating the pump irrespective of its orientation—input nozzle up or down—without impairing the conditions for cryogenic agent filling and for cryogenic agent vapour removal. The only thing that changes here is the designation of said pipes. At the same time, the possibility is ensured for fast evacuation of cryogenic agent in case of necessity.

It is also advisable that the pump be provided with a screen to be installed with a clearance on the inner side of the pump housing. The presence of the screen will reduce heat input by radiation from the pump housing to the cryogenic agent vessel, reducing cryogenic agent evaporativity and thereby improving the cryogenic characteristics of the pump.

It is advisable to have a screen installed inside the heat bridge coaxial therewith. The presence of this screen in the proposed pump design in conjunction with the screen installed on the inner side of the pump housing will considerably reduce heat input by radiation from the working chamber to the heat bridge. Besides, in the process of evacuation of the working chamber by means of the pump there occurs on the heat bridge surface having a variable temperature of between 78 and 295K an undesirable phenomenon of water vapour and gas condensation—that of carbon dioxide, freons, and some hydrocarbons—leading to an increase in the time required to evacuate the working chamber to the ultimate vacuum due to the overcondensation effect. The presence of said screen permits of excluding this phenomenon, thereby improving the characteristics of the pump.

It is convenient that the pump be provided with stems, one to be secured in the bottom of the housing, the other in the inlet nozzle of the pump, with depressions for the stems to rest in to be provided in the cover of the upper shell of the cryogenic agent vessel and in the bottom of the lower shell thereof. The presence of the stems and the provision of said depressions in the bottom and cover of the shells of the cryogenic agent vessel make it possible to rigidly locate the cryogenic agent vessel within the pump housing, thus preventing damage to the inner elements of the pump during transportation.

BRIEF DESCRIPTION OF THE DRAWINGS

The present invention will be better understood upon considering the following detailed description of a cryogenic sorption pump according to the invention with due reference to the accompanying drawings, wherein.

DETAILED DESCRIPTION OF THE INVENTION

Figure 1:
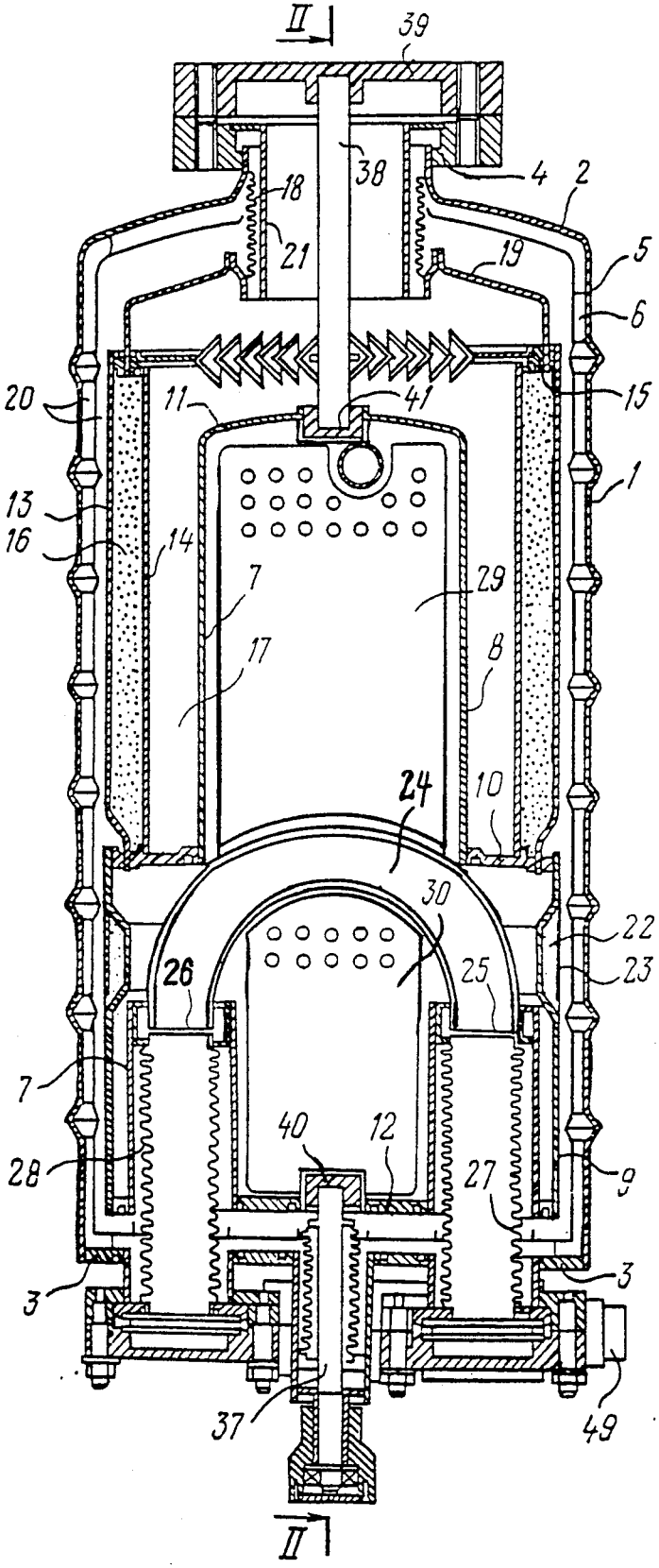
FIG. 1 is a vertical sectional view of a cryogenic sorption pump, according to the invention.

The cryogenic sorption pump comprises a housing 1 (FIG. 1) complete with a cover 2, a bottom 3, and an inlet nozzle 4 arranged on the cover 2. The pump is provided with a screen 5 installed with a clearance 6 on the inner side of the pump housing 1. Accommodated in the central part of the pump housing 1 is a vessel 7 for cryogenic agent, having the form of two shells—upper shell 8 and lower shell 9—installed one over the other and interconnected with a circular element 10. The upper shell 8 has a cover 11 while the lower shell 9 is provided with a bottom 12. The cryogenic agent vessel 7 is provided with a heat conductor 13 secured to the circular element 10. Thus, cooling of the heat conductor 13 is by means of cryogenic agent through the circular element 10. The design of the cryogenic agent vessel 7 in the form of two shells 8 and 9 arranged in the central part of the pump and interconnected with the circular element 10, as well as the provision of the heat conductor 13 attached to the circular element 10, with the interspace formed between the upper shell 8 and the heat conductor 13, firstly, provide the possibility of cooling the heat conductor 13 by cryogenic agent through the circular element 10 and, secondly, permit of maximizing the diameter of the heat conductor 13.

The heat conductor 13 encompasses the upper shell 8, forming an interspace wherein a gas-permeable screen 14 is installed, the screen 14 being attached to the circular element 10. The heat conductor 13 and the gas-permeable screen 14 are connected by means of a ring 15. An adsorbent 16 is spaced between the heat conductor 13 and the gas-permeable screen 14. A space 17 formed between the gas-permeable screen 14 and the shell 8 serves for feeding the gas pumped out of the working chamber to the adsorbent 16.

The arrangement of the gas-permeable screen 14 within the interspace between the heat conductor 13 and the upper shell 8 permits of increasing the surface area of the gas-permeable screen 14 on account of the increased screen diameter, enhancing thereby the pumping speed. The arrangement of the adsorbent 16 between the heat conductor 13 and the gas-permeable screen 14 affords effective cooling for the adsorbent 16 while preventing ingress of adsorbent dust into the working chamber. With the adsorbent 16 having a limited thickness, its total volume increases due to the increased diameters of the heat conductor 13 and the gas-permeable screen 14, hence due to the increased cross-sectional area of the annular space accommodating the adsorbent, thereby enhancing the adsorption capacity of the pump.

Connected to the inlet nozzle 4 is one of the ends of a heat bridge 18 designed as a bellows. The other end of the heat bridge 18 is connected to a circular cover 19 which in turn is attached to the ring 15.

The space between the inner surface of the housing 1 and the outer surfaces of the heat bridge 18, circular cover 19, heat conductor 13, lower shell 9, and the bottom 12 of the lower shell 9 serves to form a "protective" vacuum spacing 20.

The heat bridge 18 has a screen 21 installed coaxial with the heat bridge 18, with a clearance.

On the side surface of the lower shell 9 there is provided a pocket 22 of circular section, to contain the adsorbent 16. The pocket 22 is covered over by a gas-permeable screen 23 facing the protective vacuum spacing 20. The adsorbent 16 contained in the pocket 22 is intended for evacuation of the residual gas from the protective vacuum spacing 20.

Installed in the cavity of the lower shell 9 of the cryogenic agent vessel 7 is a vacuum conductor 24 designed for preliminary evacuation of the working chamber and performing the function of a freeze-out trap whose walls will condense such gases and vapours as may diffuse from the mechanical fore pump into the working chamber and are easily condensible at the cryogenic agent temperature. The vacuum conductor 24 is an optically dense element, with its ends 25 and 26 being provided with heat bridges 27 and 28, respectively, and taken out through the bottom 3 of the housing 1.

Taking the two ends 25 and 26 of the vacuum conductor 24 out through the bottom 3 of the pump housing 1 affords the provision of an optically dense vacuum conductor. The arrangement of the vacuum conductor within the cavity of the lower shell 9 permits of increasing the diameter of the vacuum conductor 24 and decreasing its length so that the conduction capacity of the vacuum conductor may be enhanced and the time required for preliminary evacuation of the working chamber thereby reduced.

The vacuum conductor 24 is fitted with heat conductors 29 and 30 secured thereto and installed within the shells 8 and 9, respectively, through their lengths.

The provision of the vacuum conductor 24 with the heat conductors 29 and 30 enables constant temperature to be maintained in the walls of the vacuum conductor 24 whatever the level of cryogenic agent in the vessel 7 and irrespective of the orientation—upward or downward—of the pump inlet nozzle 4.

Figure 2:
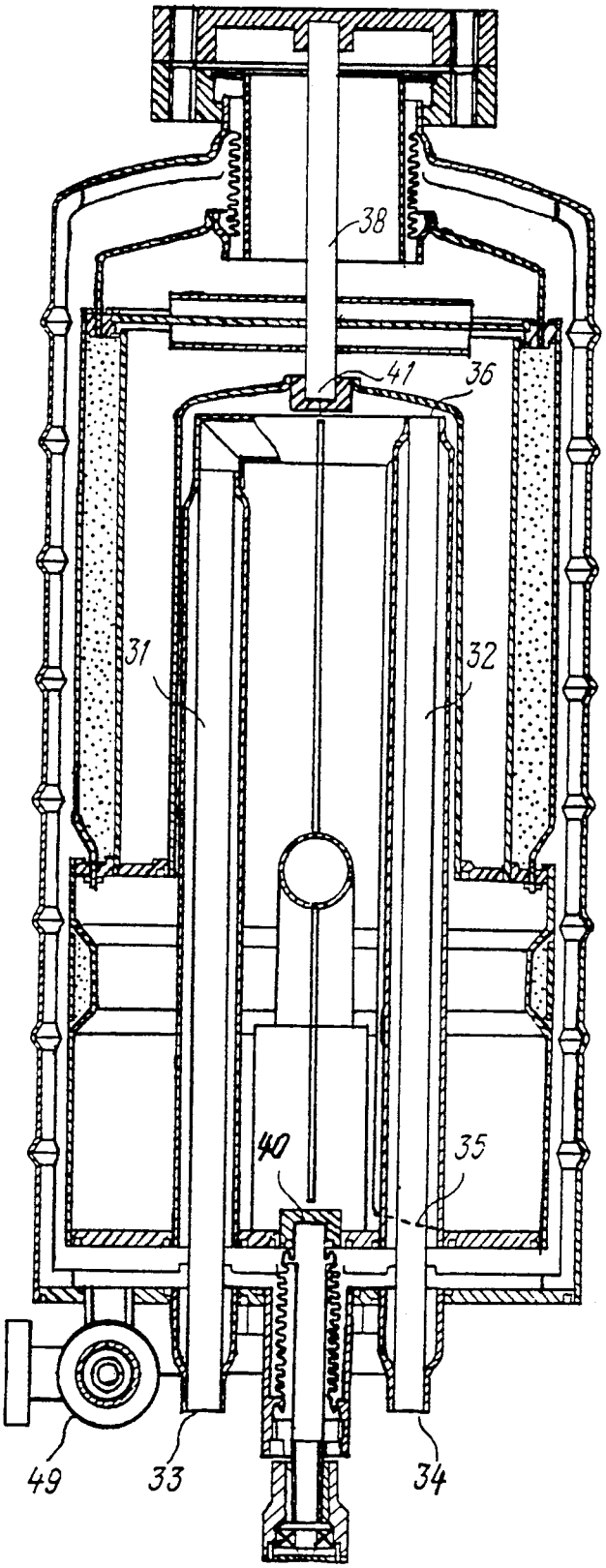
FIG. 2 is a cross sectional view taken along the line II—II of FIG. 1.

The pump is provided with a pipe 31 (FIG. 2) for filling in the cryogenic agent and a pipe 32 for removing the cryogenic agent vapours, said pipes being arranged within the cavities of the shells 8 and 9 of the cryogenic agent vessel 7. Each of the pipes 31 and 32 has one of its ends—33 and 34, respectively—taken out of the housing 1 through the bottom 3, while the other end 35 of the pipe 31, having a U-shaped form, is disposed near the bottom 12 of the lower shell 9, and the end 36 of the pipe 32 near the cover 11 of the upper shell 8. The design of the pipes 31 and 32 adapted, respectively, for filling in the cryogenic agent and for removing the cryogenic agent vapours and the arrangement of their ends 35 and 36, respectively, as described above, allows of filling cryogenic agent into the space of the cryogenic agent vessel 7 irrespective of the orientation—upward or downward—of the pump inlet nozzle 4. With the inlet nozzle 4 facing upwards, the cryogenic agent is filled in through the pipe 31, while with the pump oriented so that the inlet nozzle 4 faces downwards the pipe 32 is used to fill in the cryogenic agent.

The pump is provided with two stems 37 and 38 installed along the pump axis, the stem 37 being secured in the bottom 3 of the housing 1, and the stem 38 being attached through a blank flange 39 to the inlet nozzle 4. The end of the stem 37 is conjugated with a depression 40 provided in the bottom 12 while the end of the stem 38 is conjugated with a depression 41 provided in the cover 11.

Figure 3:
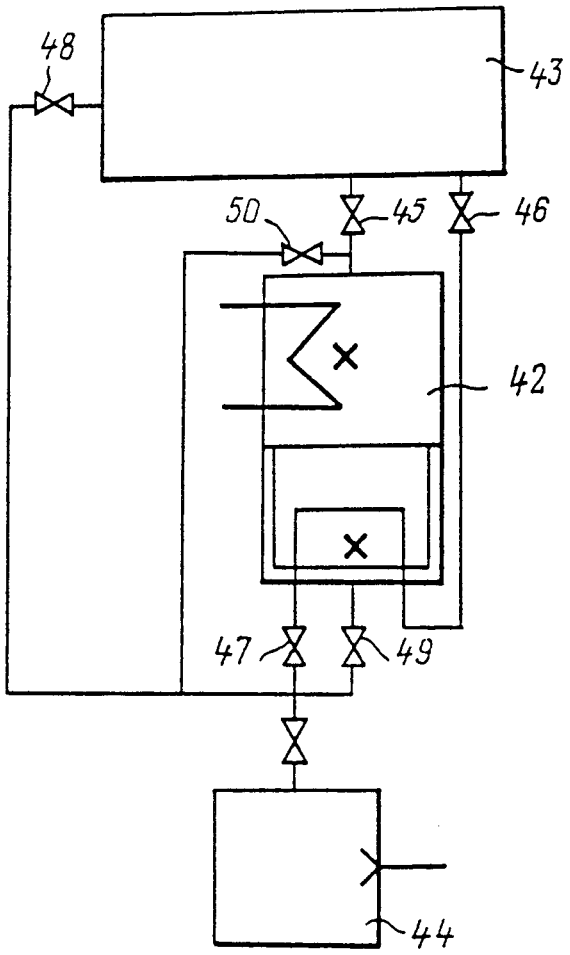
FIG. 3 is a connection diagram showing connections between the proposed pump, the working chamber, and the mechanical fore pump.

FIG. 3 is a diagram showing the connections of the proposed cryogenic sorption pump 42 with the working chamber 43 to be evacuated and a mechanical fore pump 44.

The proposed pump 42 has its inlet nozzle 4 connected to the working chamber 43 via a valve 45. One end 25 of the vacuum conductor 24 of the proposed pump 42 is connected via the heat bridge 27 with a valve 46, and therethrough with the working chamber 43, while the other end 26 of the vacuum conductor 24 is connected via the heat bridge 28 with a valve 47, and therethrough with the mechanical fore pump 44. Connected with the fore pump 44 are the working chamber 43, via a valve 48, the protective vacuum spacing 20 of the pump 42, via a valve 49, and the entire space of the pump 42, downstream of the inlet nozzle 4, via a valve 50.

The cryogenic sorption pump operates as follows.

When first starting up the pump 42, the mechanical fore pump 44 is used to evacuate the protective vacuum spacing 20 of the pump 42 via the valve 49. Normally, it is sufficient for this operation to be done once in a year or two.

To get the pump 42 ready for operation, the entire volume of said pump, downstream of the inlet nozzle 4, including the space 17 is evacuated by means of the pump 44 via the valve 50 until a pressure of 100 to 40 Pa is reached.

Next, a cryogenic agent, e.g. liquid nitrogen, is filled into the cryogenic agent vessel 7 through the pipe 31 or 32 (depending on the pump orientation). As a result of the cryogenic agent vessel 7 being cooled, the adsorbent contained in the pocket 22 likevise becomes cooled, absorbing the residual gas contained within the protective vacuum spacing 20, with the pressure in the protective vacuum spacing 20 going down to $1 \cdot 10^{-4}$ Pa or lower and resulting in lower heat inputs to the cryogenic agent vessel 7 from the housing 1 owing to molecular heat exchange by residual gases. It is for this reason that heat inputs to the cryogenic agent vessel 7 will be minimized irrespective of the pressure at input to the pump.

The residual gas in the entire volume of the pump downstream of the inlet nozzle 4, including the space 17, is absorbed by the adsorbent 16 located between the heat conductor 13 and the gas-permeable screen 14.

On completion of all aforesaid operations, the pump is ready for service.

Evacuation of the working chamber 43 comprises a preliminary stage involving the use of the mechanical fore pump in conjunction with the valve 48 down to a pressure of 100 to 40 Pa, then the use of the vacuum conductor 24, through the valves 46 and 47, down to a pressure of 5 to 1 Pa. At the preliminary stage of evacuation of the working chamber 43, the vacuum conductor 24 assumes the function of a freezeout trap, whose walls will condense oil vapour diffusing from the fore pump.

To this end, the valves 46 and 47 are closed while opening the valve 45, and the working chamber 44 is evacuated by means of the inventive pump 42 down to the desired pressure.

INDUSTRIAL APPLICABILITY

The present invention may be used to best advantage in vacuum engineering having wide outlets in electronic, radio, and other industries, as well as in research and development, both as a preliminary means and the principal means for obtaining superclean oil-free vacuum in working chambers of $1 \cdot 10^{-3}$ to $1 \cdot 10^{2}$ $m^3$ volume and with a pressure range of $1 \cdot 10^{5}$ to $1 \cdot 10^{-2}$ or $1 \cdot 10^{2}$ to $1 \cdot 10^{-5}$ Pa or lower.

I claim:

1. A cryogenic sorption pump comprising a housing complete with a cover, a bottom, and an inlet nozzle arranged on the cover, a vessel for cryogenic agent accommodated within the housing, an adsorbent, a first gas-permeable screen located on the inner side of the housing, a heat bridge connected to said inlet nozzle, a vacuum conductor arranged within the space of the cryogenic agent vessel and having one end taken out of the housing through the bottom, and pipes to fill in cryogenic agent and remove cryogenic agent vapours, wherein the improvement comprises the vessel for cryogenic agent comprising upper and lower shells installed in the central part of the pump one over the other and interconnected by a circular element, the upper shell comprising a cover, and the lower shell comprising a bottom; a heat conductor for said cryogenic agent vessel and attached to the circular element and encompassing the upper shell to form an interspace between the upper shell and the heat conductor; a second gas-permeable screen attached to the circular element and in the interspace between the upper shell and the heat conductor; the adsorbent being located between the heat conductor and the second gas-permeable screen; and a heat conductor for said vacuum conductor and attached thereto and installed within the cryogenic agent vessel shells along their entire length, with the other end of the vacuum conductor being taken out of the housing through the bottom.

2. A pump as defined in claim 1, wherein the pipes used to fill in cryogenic agent and remove cryogenic agent vapours are arranged within the space of the cryogenic agent vessel and have first ends taken out of the housing through the bottom, with a second end of one of the pipes being located near the cover of the upper shell, and a second end of the second pipe being located near the bottom of the lower shell.

3. A pump as defined in claims 1 or 2, further comprising a third screen installed with a clearance on the inner side of the pump housing.

4. A pump as defined in claim 3, wherein a fourth screen is installed inside the heat bridge and coaxial therewith.

5. A pump as defined in claim 4, further comprising first and second stems, said first stem being secured in the housing bottom and the second stem being secured in the inlet nozzle of the pump, and depressions for the stems to rest in being provided in the cover of the upper shell of the cryogenic agent vessel and in the bottom of the lower shell thereof.

* * * * *